US008666613B2

(12) United States Patent
Choi

(10) Patent No.: US 8,666,613 B2
(45) Date of Patent: Mar. 4, 2014

(54) SWING CONTROL SYSTEM FOR HYBRID CONSTRUCTION MACHINE

(75) Inventor: Dong-Uk Choi, Changwon-si (KR)

(73) Assignee: Volvo Construction Equipment AB, Eskilstuna (SE)

( * ) Notice: Subject to any disclaimer, the term of this patent is extended or adjusted under 35 U.S.C. 154(b) by 0 days.

(21) Appl. No.: 13/993,155

(22) PCT Filed: Dec. 15, 2010

(86) PCT No.: PCT/KR2010/008958

§ 371 (c)(1),
(2), (4) Date: Aug. 6, 2013

(87) PCT Pub. No.: WO2012/081742

PCT Pub. Date: Jun. 21, 2012

(65) Prior Publication Data

US 2013/0311054 A1 Nov. 21, 2013

(51) Int. Cl.
*G06F 7/70* (2006.01)

(52) U.S. Cl.
USPC ..... 701/50; 701/124; 180/336; 180/337; 700/213; 414/694; 414/699

(58) Field of Classification Search
USPC ..... 701/50, 124; 180/336, 337
See application file for complete search history.

(56) References Cited

U.S. PATENT DOCUMENTS

| | | | | |
|---|---|---|---|---|
| 5,557,526 | A * | 9/1996 | Anderson | 701/50 |
| 6,385,519 | B2 * | 5/2002 | Rocke | 701/50 |
| 6,947,819 | B2 * | 9/2005 | Nelson et al. | 701/50 |
| 7,082,375 | B2 * | 7/2006 | Lueschow | 702/101 |
| 2009/0139119 | A1 * | 6/2009 | Janardhan et al. | 37/413 |

FOREIGN PATENT DOCUMENTS

| | | |
|---|---|---|
| KR | 1020080045314 | 5/2008 |
| KR | 1020080112185 | 12/2008 |

OTHER PUBLICATIONS

International Search Report mailed Sep. 29, 2011 for PCT/KR2010/008958.

* cited by examiner

*Primary Examiner* — Redhwan k Mawari
(74) *Attorney, Agent, or Firm* — Lowe Hauptman & Ham, LLP

(57) ABSTRACT

A swing control system for a hybrid construction machine has a swing operating lever, an electric swing motor, a speed detection sensor which detects the rotary speed of a swing motor, a controller that calculates the driving speed of the swing motor by a swing operating signal created by the operation of the swing operating lever and by a detecting signal of the rotary speed, an inverter which drives the swing motor by a control signal from the controller, a swing inertia detector that detects the swing inertia of equipment and an inertia torque compensator which compares the torque compensation value in accordance with the equipment inertia, and outputs a calculated torque value for controlling the swing motor to the inverter.

4 Claims, 2 Drawing Sheets

SWING CONTROL SYSTEM FOR HYBRID CONSTRUCTION MACHINE

CROSS REFERENCE TO RELATED APPLICATION

This application is a National Phase application of International Application No. PCT/KR2010/008958 filed on Dec. 15, 2010, which designates the United States and was published in Korean.

FIELD OF THE INVENTION

The present invention relates to a swing control system for a hybrid construction machine, which enables an upper swing structure to be swiveled with respect to a lower traveling structure by the driving of an electric swing motor. More particularly, the present invention relates to such a swing control system which enables a swing motor to be driven at constant swing acceleration irrespective of a change in the machine.

BACKGROUND OF THE INVENTION

Recently, a construction machine such as a hybrid excavator is employed which is equipped with a swing apparatus that swivels an upper swing structure with respect to a lower traveling structure using an electric swing motor driven by electric energy.

As shown in FIG. 1, a swing control system for a hybrid construction in accordance to the prior art includes:

a swing manipulation lever (not shown) that outputs a swing manipulation signal that is proportional to a manipulation amount by an operator;

an electric swing motor 1 that is driven in response to an electric control signal corresponding to the manipulation amount of the swing manipulation lever to cause an upper swing structure to be swiveled with respect to a lower traveling structure;

a speed detection sensor 2 that detects a rotational speed of the swing motor 1;

a controller 3 that calculates a driving speed of the swing motor 1 based on the swing manipulation signal by the manipulation of the swing manipulation lever and a rotational speed detection signal, which is fed back thererto from the speed detection sensor 2;

an inverter 4 that converts DC into AC in response to a control signal, which is applied thereto from the controller 13, and applies the converted AC power to the swing motor 1 to drive the swing motor 1.

When the swing manipulation signal according to the manipulation of the swing manipulation lever by the operator and the rotational speed detection signal, which is fed back thererto from the speed detection sensor 2, are applied to the controller 3, the controller 3 can calculate a driving speed of the swing motor 1 based on the swing manipulation signal and the rotational speed detection signal to cause the swing motor 1 to be driven based on a current value for control applied to the inverter 4 from the controller 3.

Meanwhile, as in a loading work using an excavator, during a combined operation in which the swing operation of the machine and the driving operation of the work apparatus including a boom and the like are performed, the swing inertia of the machine varies depending on a change in position of the work apparatus, leading to a change in the swing acceleration of the machine.

In this case, as shown in FIG. 2, the swing acceleration a of the machine is in inverse proportion to the swing inertia J of the machine ($(J \propto 1/\alpha)$). This becomes an obstacle factor to maintain repeatability of the swing operation, resulting in a deterioration in the workability in the case where the operator performs the combined operation of the machine and the work apparatus.

DETAILED DESCRIPTION OF THE INVENTION

Technical Problems

Accordingly, the present invention was made to solve the aforementioned problem occurring in the prior art, and it is an object of the present invention to provide an swing control system for a hybrid construction machine, which enables a swing motor to be driven to maintain a constant swing acceleration irrespective of the change in the swing inertia of the machine, thereby improving repeatability of the swing operation and thus enhancing workability of the machine.

Technical Solution

To accomplish the above object, in accordance with an embodiment of the present invention, there is provided a swing control system for a hybrid construction machine including:

a swing manipulation lever configured to output a swing manipulation signal that is proportional to a manipulation amount by an operator;

an electric swing motor configured to be driven in response to an electric control signal corresponding to the manipulation amount of the swing manipulation lever;

a speed detection sensor configured to detect a rotational speed of the swing motor;

a controller configured to calculate a driving speed of the swing motor based on the swing manipulation signal by the manipulation of the swing manipulation lever and a rotational speed detection signal, which is fed back thererto from the speed detection sensor;

an inverter configured to drive the swing motor based on a current value for control, which is applied thereto from the controller;

a swing inertia detector configured to detect a swing inertia of the machine, which varies depending on a change in position of a work apparatus that includes a boom, an arm, a bucket, and a hydraulic cylinder for driving the boom, the arm, and the bucket, and output a torque compensation value or a swing inertia detection signal corresponding to the torque compensation value according to the detected swing inertia of the machine; and an inertia torque compensator configured to compare the torque compensation value according to the machine inertia that is outputted from the swing inertia detector with a torque value outputted from the controller, and output a calculated torque value for controlling the swing motor to the inverter.

According to a more preferable embodiment, the swing inertia detection signal outputted from the swing inertia detector is transmitted to the inertia torque compensator by any one selected from an analog signal, a digital signal, a wire communication signal, and a wireless communication signal.

In addition, the swing inertia detector detects a position change value of each of hydraulic cylinders for the work apparatus in real time and detects the swing inertia of the machine using a combination of the detected position change values of the hydraulic cylinders.

The swing inertia detector compares a speed feedback value and a current feedback value of the swing motor, which is fedback thereto from the rotational speed detection sensor to predict an acceleration value and a torque value of the swing motor, and then, transmits an inertia value to the inertia torque compensator while detecting the values in real time.

Advantageous Effect

The swing control system for a hybrid construction machine according to an embodiment of the present invention as constructed above has the following advantages.

A torque is compensated according to a change in the swing inertia of the machine so that the swing motor is controlled to maintain a constant swing acceleration irrespective of the change in the swing inertia of the machine, thereby improving repeatability of the swing operation and thus enhancing workability of the machine.

BRIEF DESCRIPTION OF THE INVENTION

The above objects, other features and advantages of the present invention will become more apparent by describing the preferred embodiments thereof with reference to the accompanying drawings, in which.

Figure 4:
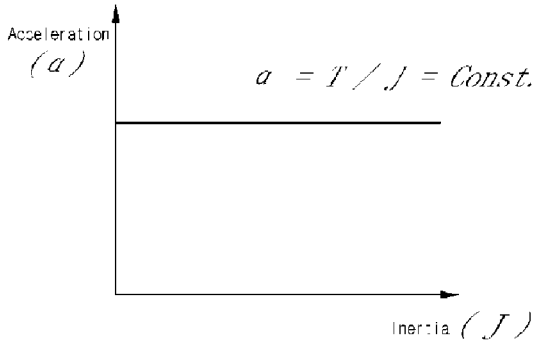
Figure 5:
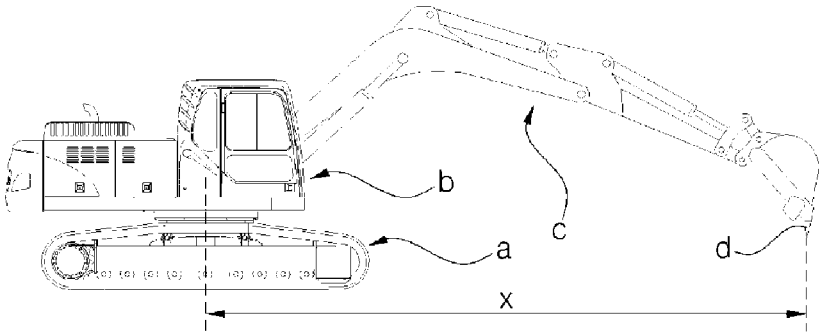

FIG. 4 is a graph illustrating the correlation between an acceleration of the swing motor and an inertial of the machine in a swing control system for a hybrid construction machine in accordance with the present invention; and FIG. 5 is a schematic diagrammatic view illustrating an excavator employing a swing control system for a hybrid construction machine in accordance with the present invention.

EXPLANATION ON REFERENCE NUMERALS OF MAIN ELEMENTS IN THE DRAWINGS

11: swing motor
12: speed detection sensor
13: controller
14: inverter (inverter)
15: swing inertia detector
16: inertia torque compensator

PREFERRED EMBODIMENTS OF THE INVENTION

Now, preferred embodiments of the present invention will be described in detail with reference to the accompanying drawings. The matters defined in the description, such as the detailed construction and elements, are nothing but specific details provided to assist those of ordinary skill in the art in a comprehensive understanding of the invention, and the present invention is not limited to the embodiments disclosed hereinafter.

Figure 1:
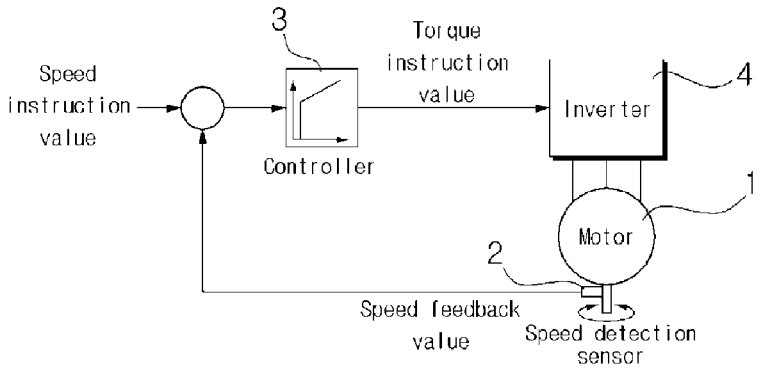
FIG. 1 is a schematic block diagram showing the configuration of a swing control system for a hybrid construction machine in accordance with the prior art.
Figure 2:
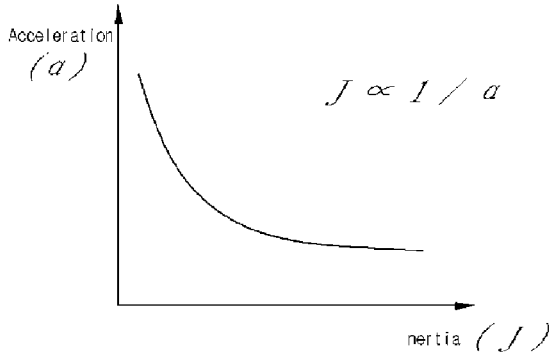
FIG. 2 is a graph illustrating the correlation between an acceleration of the swing motor and an inertial of the machine in the swing control system in accordance with the prior art.
Figure 3:
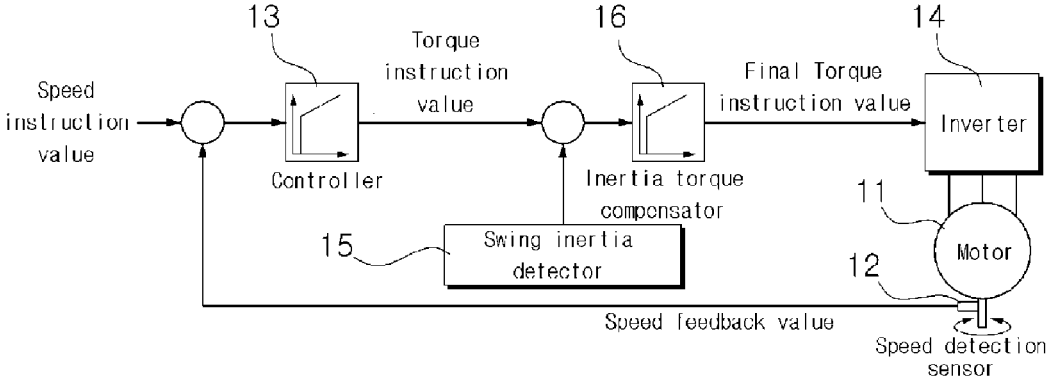
FIG. 3 is a schematic block diagram showing the configuration of a swing control system for a hybrid construction machine in accordance with the present invention.

As shown in FIGS. 3 to 5, a swing control system for a hybrid construction machine according to an embodiment of the present invention includes:

a swing manipulation lever (not shown) that outputs a swing manipulation signal that is proportional to a manipulation amount by an operator;

an electric swing motor 11 that is driven in response to an electric control signal corresponding to the manipulation amount of the swing manipulation lever to cause an upper swing structure b to be swiveled with respect to a lower traveling structure a;

a speed detection sensor 12 that detects a rotational speed of the swing motor 11;

a controller 13 that calculates a driving speed of the swing motor 11 based on the swing manipulation signal by the manipulation of the swing manipulation lever and a rotational speed detection signal, which is fed back thererto from the speed detection sensor 12;

an inverter 14 that drives the swing motor 11 based on a current value for control, which is applied thereto from the controller 13, and convert DC into AC;

a swing inertia detector 15 that detects a swing inertia of the machine, which varies depending on a change in position of a work apparatus c that includes a boom, an arm, a bucket, and a hydraulic cylinder for driving the boom, the arm, and the bucket, and outputs a torque compensation value or a swing inertia detection signal corresponding to the torque compensation value according to the detected swing inertia of the machine; and an inertia torque compensator that compares the torque compensation value according to the machine inertia that is outputted from the swing inertia detector 15 with a torque value outputted from the controller 13, and outputs a calculated torque value for controlling the swing motor 11 to the inverter 14.

In this case, although not shown, the swing inertia detection signal outputted from the swing inertia detector 15 is transmitted to the inertia torque compensator 16 by any one selected from an analog signal, a digital signal, a wire communication signal, and a wireless communication signal.

The swing inertia detector 15 detects a position change value of each of hydraulic cylinders for the work apparatus in real time and detects the swing inertia of the machine using a combination of the detected position change values of the hydraulic cylinders.

The swing inertia detector 15 compares a speed feedback value and a current feedback value of the swing motor 11, which is fedback thereto from the rotational speed detection sensor 12 to predict an acceleration value and a torque value of the swing motor, and then, transmits an inertia value to the inertia torque compensator 16 while detecting the values in real time.

Hereinafter, a use example of the swing control system for a hybrid construction machine in accordance with the present invention will be described in detail with reference to the companying drawings.

As shown in FIGS. 3 and 5, a torque value of the swing motor according to the manipulation amount of the swing manipulation lever by an operator and a speed feedback value according to an actual drive of the swing motor 11, which is fed back from the speed detection sensor 12, are inputted to the controller 13. That is, the controller 13 compares a manipulation signal value required by the operator and the speed feedback value of the swing motor 11, and calculates a driving speed at which the swing motor 11 can be driven.

Simultaneously, the swing inertia detector 15 detects a swing inertia of the machine, which varies depending on a change in position of a work apparatus c including the bucket and the like, and outputs a torque compensation value or a swing inertia detection signal corresponding to the torque compensation value according to the detected swing inertia of the machine.

The inertia torque compensator 16 compares the torque compensation value according to the machine inertia that is outputted from the swing inertia detector 15 with a torque value outputted from the controller 13, and calculates the driving speed at which the swing motor 11 can be driven and outputs the calculated driving speed to the inverter 14.

Thus, the swing motor can be driven in response to a control signal outputted to the inverter 14 from the inertia torque compensator 16.

As an example, an inertia J of an excavator is changed depending on a distance x between a position of a bucket tip d, which varies depending on a change in position of a work apparatus c including the book and the like, and a swing reference axis, i.e., an axis of the swing motor 11. Generally, as a value of the above-mentioned distance x is increased gradually, a swing inertia value of the machine is increased.

As in a loading work using the excavator, during a combined operation in which the swing operation of the machine and the driving operation of the work apparatus are performed, the swing inertia of the machine varies depending on a change in position of the work apparatus c. This swing inertia of the machine is changed by the correlation of a torque T, an inertia J, and an acceleration a. The swing acceleration a of the machine is in inverse proportion to the swing inertia J of the machine if the torque T is constant, which is written by the following equation:

$$T=J\times\alpha,\ \alpha=T/J.$$

A change in the swing inertia of the machine according to a change in the distance x value is compensated by the swing inertia detector 15 through the control of the torque value, i.e., the torque T/the inertia J is controlled constantly so that the acceleration of the swing motor 11 can be controlled constantly (see graph of FIG. 4). That is, the swing motor is controlled to maintain a constant swing acceleration irrespective of the change in the swing inertia of the machine. Thus, during the loading work, the acceleration performance of the swing apparatus according to a change in position of the work apparatus c can be maintained constantly. Resultantly, in case of the loading work using an excavator, repeatability of the swing operation can be improved and thus workability of the machine can be enhanced.

INDUSTRIAL APPLICABILITY

According to the swing control system for a hybrid construction machine in accordance with the present invention, the rotational speed value of the swing motor and the swing inertia of the machine are compared with each other to compensate for a torque according to a change in the swing inertia, so that the swing motor can maintain a constant swing acceleration irrespective of the change in the swing inertia of the machine, thereby improving repeatability of the swing operation.

The invention claimed is:

1. A swing control system for a hybrid construction machine comprising:

a swing manipulation lever configured to output a swing manipulation signal that is proportional to a manipulation amount of the swing manipulation lever by an operator;

an electric swing motor configured to be driven in response to an electric control signal corresponding to the manipulation amount of the swing manipulation lever;

a speed detection sensor configured to detect a rotational speed of the swing motor;

a controller configured to calculate a driving speed of the swing motor based on the swing manipulation signal by the manipulation of the swing manipulation lever and a rotational speed detection signal, which is fed back thererto from the speed detection sensor;

an inverter configured to drive the swing motor based on a current value for control, which is applied thereto from the controller;

a swing inertia detector configured to detect a swing inertia of the machine, which varies depending on a change in position of a work apparatus and output a torque compensation value or a swing inertia detection signal corresponding to the torque compensation value according to the detected swing inertia of the machine; and an inertia torque compensator configured to compare the torque compensation value according to the machine inertia that is outputted from the swing inertia detector with a torque value outputted from the controller, and output a calculated torque value for controlling the swing motor to the inverter.

2. The swing control system according to claim 1, wherein the swing inertia detection signal outputted from the swing inertia detector is transmitted to the inertia torque compensator by any one selected from an analog signal, a digital signal, a wire communication signal, and a wireless communication signal.

3. The swing control system according to claim 1, wherein the swing inertia detector (15) detects a position change value of each of hydraulic cylinders for the work apparatus in real time and detects the swing inertia of the machine using a combination of the detected position change values of the hydraulic cylinders.

4. The swing control system according to claim 1, wherein the swing inertia detector compares a speed feedback value and a current feedback value of the swing motor, which is fedback thereto from the rotational speed detection sensor to predict an acceleration value and a torque value of the swing motor, and then, transmits an inertia value to the inertia torque compensator while detecting the values in real time.

* * * * *